US009153102B2

(12) United States Patent
Meyer

(10) Patent No.: US 9,153,102 B2
(45) Date of Patent: Oct. 6, 2015

(54) ELECTRONIC GAMING MACHINE AND GAMING METHOD

(71) Applicant: AINSWORTH GAME TECHNOLOGY LIMITED, Newington, NSW (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 93 days.

(21) Appl. No.: 13/793,467

(22) Filed: Mar. 11, 2013

(65) Prior Publication Data

US 2014/0141860 A1 May 22, 2014

(30) Foreign Application Priority Data

Nov. 20, 2012 (AU) ..... 2012905079

(51) Int. Cl.
*G07F 17/32* (2006.01)

(52) U.S. Cl.
CPC ..... *G07F 17/3267* (2013.01); *G07F 17/3258* (2013.01)

(58) Field of Classification Search
CPC .. G07F 17/32; G07F 17/3258; G07F 17/3267
USPC ..... 463/16–20, 27
See application file for complete search history.

(56) References Cited

U.S. PATENT DOCUMENTS 5,833,537 A * 11/1998 Barrie ..... 463/21
6,004,207 A 12/1999 Wilson, Jr. et al.
6,328,649 B1 * 12/2001 Randall et al. ..... 463/20
6,346,043 B1 * 2/2002 Colin et al. ..... 463/17
6,537,152 B2 * 3/2003 Seelig et al. ..... 463/30
6,561,904 B2 * 5/2003 Locke et al. ..... 463/25
6,869,360 B2 * 3/2005 Marks et al. ..... 463/25
7,258,611 B2 * 8/2007 Bigelow et al. ..... 463/25
7,381,134 B2 * 6/2008 Cuddy et al. ..... 463/25
7,530,894 B1 5/2009 Marks et al.
7,980,946 B2 7/2011 Marks et al.
8,029,358 B2 * 10/2011 Bigelow et al. ..... 463/25
8,272,946 B2 * 9/2012 Cuddy et al. ..... 463/25
8,277,305 B2 * 10/2012 Caputo et al. ..... 463/20
8,419,525 B2 * 4/2013 Caputo et al. ..... 463/20
8,454,429 B2 * 6/2013 Jaffe et al. ..... 463/25
8,460,094 B2 * 6/2013 Bigelow et al. ..... 463/25
8,465,362 B2 * 6/2013 Jackson ..... 463/25
8,622,809 B1 * 1/2014 Arora et al. ..... 463/20
8,702,489 B2 * 4/2014 Cuddy et al. ..... 463/16
2003/0162585 A1 * 8/2003 Bigelow et al. ..... 463/20

(Continued)

OTHER PUBLICATIONS

Cleopatra II™ Enhanced Video Shots, Brochure, 2 pages, IGT™ International Game Technology (2004).

*Primary Examiner* — Michael Cuff
(74) *Attorney, Agent, or Firm* — Cook Alex Ltd.

(57) ABSTRACT

An electronic gaming machine includes an electronic game controller and a display where game symbols are arranged in an array of predetermined game positions. The appearance of at least one special symbol in a first play of a game causes the electronic game controller to increase the value of a prize awarded for a predetermined winning combination, the increase being associated with a numerical value associated with the special symbol. Also, the numerical value associated with the special symbol sequentially increases for one or more subsequent plays of the game. A gaming method is also provided.

20 Claims, 7 Drawing Sheets

(56) References Cited

U.S. PATENT DOCUMENTS

| | | | | |
|---|---|---|---|---|
| 2003/0181233 | A1* | 9/2003 | Baerlocher et al. | 463/16 |
| 2004/0087359 | A1* | 5/2004 | Cuddy et al. | 463/20 |
| 2005/0250578 | A1* | 11/2005 | Slomiany et al. | 463/20 |
| 2006/0063582 | A1* | 3/2006 | Baerlocher et al. | 463/16 |
| 2007/0281778 | A1* | 12/2007 | Bigelow et al. | 463/20 |
| 2008/0200237 | A1* | 8/2008 | Cuddy et al. | 463/20 |
| 2009/0075722 | A1* | 3/2009 | Louie et al. | 463/20 |
| 2011/0312406 | A1* | 12/2011 | Bigelow et al. | 463/20 |
| 2012/0322535 | A1* | 12/2012 | Englman et al. | 463/20 |
| 2013/0005430 | A1* | 1/2013 | Cuddy et al. | 463/20 |
| 2013/0023334 | A1* | 1/2013 | Bennett et al. | 463/21 |
| 2014/0057699 | A1* | 2/2014 | Pade et al. | 463/21 |

* cited by examiner

ELECTRONIC GAMING MACHINE AND GAMING METHOD

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may be provided by an electronic gaming machine in addition to the base or main game. Typically feature games use the same set of reels as the main game and are limited to a set of free games operated under a single set of rules. Once the free feature games have been played, the electronic gaming machine resets itself and returns the player back to the base game. This standard structure to game play limits the variation in the play of the electronic gaming machine. Consequently, it is difficult to retain player interest because there is no apparent incentive for the player to continue playing the same electronic gaming machine once the player becomes familiar with the feature game and the main game. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

It is an object of the invention in at least one preferred form to provide an electronic gaming machine and a method for controlling an electronic gaming machine that encourages player interest.

SUMMARY

According to a first aspect of the invention, there is provided an electronic gaming machine comprising:

a display for displaying game symbols for playing a game, where game symbols are arranged in an array of predetermined game positions and predetermined winning combinations of randomly selected game symbols in said game award prizes to a player, and an electronic game controller for controlling the display of game symbols on the display, said electronic game controller determining the appearance of one or more special symbols in said game, said special symbols being associated with numerical values, wherein the appearance of at least one special symbol in a first predetermined game position of a predetermined winning combination in a first play of said game causes said electronic game controller to increase the value of a prize awarded for said predetermined winning combination, said increase being associated with the numerical value associated with said at least one special symbol, and said electronic game controller sequentially increases the numerical value associated with said at least one special symbol for one or more subsequent plays of said game.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Preferably, said at least one special symbol is displayed in said first predetermined game position in each subsequent play of said game.

Preferably, said numerical value sequentially increases by one for each said subsequent play of said game.

Preferably, said numerical value is one. More preferably, said numerical value is two.

Preferably, said increase comprises multiplying the prize by said numerical value.

Preferably, said electronic game controller increases the value of a prize awarded for a predetermined winning combination appearing in each said subsequent play, said predetermined winning combination comprising said first predetermined game position and said increase being associated with the sequentially increased numerical value. More preferably, said increase of said prize for said subsequent plays comprises multiplying the prize by said sequentially increased numerical value.

Preferably, said at least one special symbol appears in a predetermined portion of said array to trigger said sequential increase in said numerical value for said subsequent plays of said game. More preferably, said array comprises rows and columns and said predetermined portion comprises a designated column, wherein said designated column comprises a plurality of predetermined game positions. In one preferred form, each said predetermined game position comprises an individual spinning reel.

Preferably, said sequential increase of said numerical value occurs for a predetermined number of subsequent plays of said game.

Preferably, said special symbols comprise one or more multiplier symbols.

Where more than one special symbol appears in said first play or said subsequent plays, the numerical value associated with each said special symbol is applied simultaneously to each prize awarded on predetermined winning combinations appearing in said first play or said subsequent plays.

Preferably, said game comprises an indicator symbol for indicating the appearance of said special symbols. More preferably, said indicator symbol appears in said first predetermined game position. In one preferred form, said indicator symbol acts as a wild card symbol for determining whether a predetermined winning combination is displayed on said array. In a further preferred form, said indicator symbol appears in said first predetermined game position in a preceding play of said game preceding said first play.

Preferably, said numerical value associated with said at least one special symbol is indicated on said display. More preferably, said sequential increase in said numerical value is indicated during said subsequent plays of said game.

Preferably, said first play and said subsequent plays are consecutive. Alternatively, said first play and said subsequent plays are within a predetermined set of plays of said game.

Preferably, said subsequent plays are consecutive. In one preferred form, said subsequent plays occur within a predetermined number of plays of said game.

Preferably, said game comprises a base game and a feature game, wherein said one or more special symbols appear in said feature game. Alternatively, said one or more special symbols appear in said base game.

Preferably, said electronic game controller randomly determines the appearance of said indicator symbol and/or said special symbols in said game.

Preferably, in response to a trigger event, said electronic game controller causes the display of said indicator symbol in said preceding play. More preferably, said trigger event comprises said electronic game controller randomly generating a number and determining whether said randomly generated number is a predetermined number or within a predetermined range of numbers.

Alternatively, said trigger event comprises the appearance of at least one trigger symbol in said game. In one preferred form, said trigger event comprises the appearance of three trigger symbols.

Preferably, said trigger event comprises the appearance of at least one trigger symbol in said base game. More preferably, said trigger event causes said display to display game symbols for playing said feature game.

Preferably, said electronic game controller randomly determines the appearance of said at least one trigger symbol. In one preferred form, said at least one trigger symbol is substantially the same symbol as said special symbol.

Preferably, said special symbol may also act as another type of game symbol. More preferably, said special symbol may also act as at least one of a replacement symbol, a wild card symbol, a scatter symbol, bonus prizes, collector symbols, a win multiplier, wild multipliers, bonus wilds, random wild symbols, progressive symbols, bonus credits and jackpot symbols. In one preferred form, said special symbol acts as a wild card symbol.

Preferably, the same game symbols are used in said feature game and said base game. Alternatively, different game symbols or a mixture of the same and different game symbols are used in said feature game and said base game.

Preferably, said feature game has the same number of game symbols as said base game. Alternatively, said feature game and said base game have different numbers of game symbols.

Preferably, the game symbols in said feature game and said base game are organised or arranged in the same way. In another preferred form, the game symbols in said feature game and said base game are organised or arranged differently to each other.

Preferably, said game symbols in said feature game and said base game are arranged in arrays of the same shape or type. Alternatively, said game symbols in said feature game and said base game are arranged in differently shaped arrays. The shapes of said arrays are preferably rectangular, circular, triangular, oval, semi-circular or other non-rectangular shape.

Preferably, said electronic game controller causes the display of said feature game in response to said trigger event. Alternatively, said electronic game controller causes the display of said feature game and said base game during play of said base game, said feature game being inactive until triggered. In this preferred form, the change in said feature game from being inactive to active may be indicated on the display.

Preferably, said electronic game controller causes the display of said base game on a separate display to said display. Alternatively, said electronic game controller causes the display of said feature game and said base game on the same display.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

According to a second aspect of the invention, there is provided a gaming method for an electronic gaming machine comprising a display and an electronic game controller, the method comprising the steps of:

controllably displaying game symbols for playing a game, where predetermined winning combinations of randomly selected game symbols in said game results in the award of prizes to a player, said game symbols being arranged in an array of predetermined game positions;

determining the appearance of one or more special symbols in said game, said special symbols being associated with numerical values, wherein, upon the appearance of at least one special symbol on a first predetermined game position of a predetermined winning combination in a first play of said game, increasing the value of any prizes awarded for said predetermined winning combination, said increase being associated with the numerical value associated with said at least one special symbol, and sequentially increasing the numerical value associated with said at least one special symbol for one or more subsequent plays of said game.

Preferably, said method further comprises displaying said at least one special symbol in said first predetermined game position in each subsequent play of said game.

Preferably, said sequential increasing step comprises increasing said numerical value by one for each said subsequent play of said game.

Preferably, said value increasing step further comprises multiplying said prize value by said numerical value associated with said at least one special symbol.

Preferably, said method further comprises the step of increasing the value of a prize awarded for a predetermined winning combination comprising said first predetermined game position appearing in each said subsequent play, said increase being associated with the sequentially increased numerical value resulting from said sequential increasing step. More preferably, said value increasing step for said subsequent plays comprises multiplying said prize value by said sequentially increased numerical value associated with said at least one special symbol.

Preferably, said sequential increasing step occurs for a predetermined number of subsequent plays of said game.

Preferably, said method further comprises, upon more than one special symbol appears in said first play or said subsequent plays, applying the numerical value associated with each special symbol simultaneously to any prize awarded on predetermined winning combinations having said special symbols appearing in said first play or said subsequent plays.

Preferably, said method further comprises displaying an indicator symbol for indicating the appearance of said special symbols. More preferably, said indicator symbol displaying step comprises displaying said indicator symbol in said first predetermined game position. In one preferred form, said indicator symbol displaying step comprises displaying said indicator symbol in said first predetermined game position in a preceding play of said game preceding said first play. In another preferred form, said indicator symbol displaying step comprises displaying said indicator symbol in a preceding play of said game preceding said first play in response to a trigger event.

Preferably, the method further comprises indicating said numerical value associated with said at least one special symbol on said display.

Preferably, the method further comprises indicating said sequential increase in said numerical value during said subsequent plays of said game.

Alternatively, said trigger event comprises the appearance of at least one trigger symbol in said game. In one preferred form, said trigger event comprises the appearance of three trigger symbols.

Preferably, said determining step comprises randomly determining the appearance of said special symbols in said game.

Preferably, said method further comprises the step of consecutively performing said first play and said subsequent play. Alternatively, said method further comprises the step of performing said first play and said subsequent play within a predetermined set of plays of said game.

The method preferably has the preferred features of the first aspect of the invention not otherwise stated above, where applicable.

According to a third aspect of the invention, there is provided a computer system comprising a central processing unit configured for communication with an electronic gaming machine, wherein said computer system is configured to perform the method of the second aspect of the invention.

According to a fourth aspect of the invention, there is provided a computer program configured to perform the method of the second aspect of the invention.

According to a fifth aspect of the invention, there is provided a non-transitive carrier medium carrying computer executable code that, when executed on a central processing unit configured for communication with an electronic gaming machine, causes the central processing unit to perform the method of the second aspect of the invention.

BRIEF DESCRIPTION OF THE DRAWINGS

Preferred embodiments of the invention will now be described, by way of example only, with reference to the accompanying drawings in which.

DETAILED DESCRIPTION OF THE VARIOUS EMBODIMENTS

Figure 1:
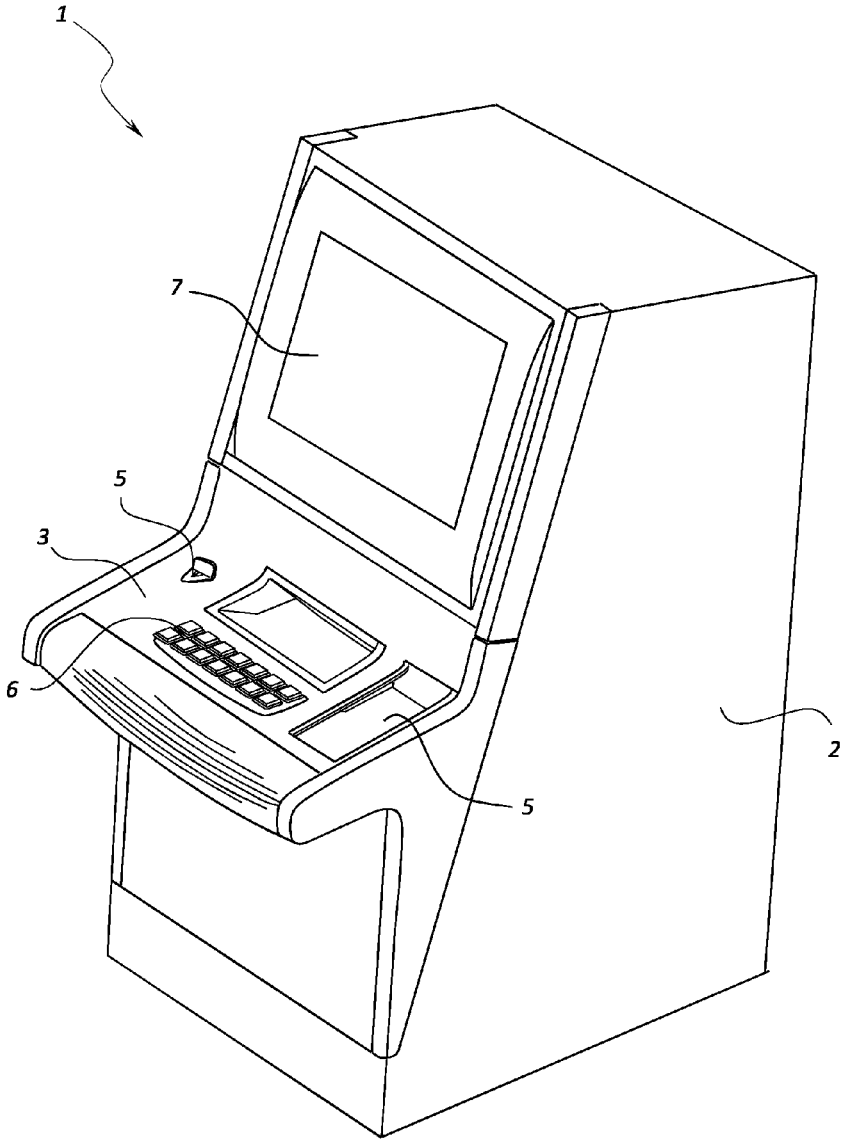
FIG. 1 is a perspective view of an electronic gaming machine according to an embodiment of the invention.
Figure 2:
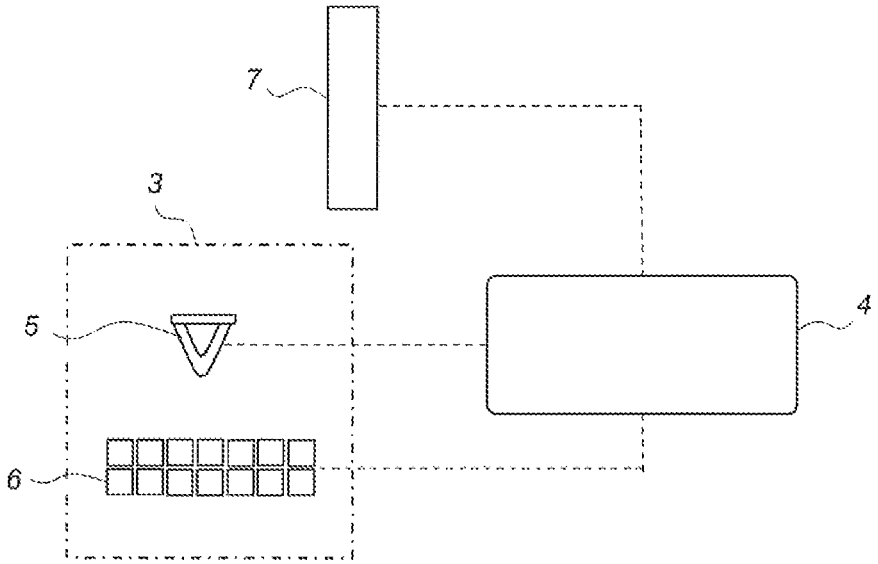
FIG. 2 is a schematic drawing of an electronic game controller for the electronic gaming machine of FIG. 1.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. The electronic game controller 4 is generally in the form of a central processing unit, such as a computer, and is in electronic communication with a display in the form of a video display screen 7, as well as various input devices on the console 3, as best shown in FIG. 2. It is also appreciated that a person skilled in the art would readily understand the location and use of the electronic game controller 4 in the electronic gaming machine 1.

The video display screen 7 is used to display game symbols 8 arranged into an array 9 in the form of five columns or "reels" 10, two reels 10*a*, 10*b* at the left hand side of the array having three rows and three reels 10*c*, 10*d*, 10*e* right hand side of the array having four rows. While the array 9 is arranged with five columns or "reels" 10 and an uneven number of rows, it will be appreciated by one skilled in the art that other arrays could be used, such as the industry standard 5×3 or 3×3, 4×3, 5×5, 4×4, etc.

The array 9 defines predetermined game positions in the form of "squares" or cells 11, in which the game symbols 8 appear. The array 9 is arranged so that a player can select one or more predetermined "pay lines" 12 defined around the array, which correspond to combinations of the game positions 11. The pay lines 12 generally comprise at least one game position 11 from each reel 10. The number of pay lines 12 that can be selected by the player depends on the amount of the monetary bet for playing a game on the array 9.

The video screen 7 also displays other standard game information, including the number of pay lines available 13, the number of player-selected pay lines 14, the amount of a single credit 15, the amount of player credits 16, the amount of the current bet wagered by the player 17, the amount of wins by the player 18 and other game related messages 19.

The electronic game controller 4 controls the display of the array 9 so that during play of a base game 20 on the array and in response to a trigger event, the electronic game controller 4 causes a feature game 21 to be displayed on the array.

The game symbols 8 include a mixture of picture symbols in the form of animal symbols 8*a*, playing card symbols 8*b* and wild card symbols (not shown). There are also diamond symbols 8*c* that act as scatter symbols to trigger the feature game 21 in this embodiment.

The player initially makes a bet using vending slots 5 initiate play of the base game 20 on the electronic gaming machine 1. For example, the player can bet or wager 50 credits to play 10 pay lines or 200 credits to play 50 pay lines. Also, the player can make any additional side bets or ante-bets to access additional features in the base game, such as increasing the number of winning combinations in the base game.

The electronic game controller 4 then causes the reels 10*a* to 10*e* to appear to visibly rotate or "spin", and randomly display the game symbols 8 in each cell 11. After the reels 10*a* to 10*e* stop spinning, the electronic game controller 4 determines whether there are any predetermined winning combinations of the game symbols 8 appearing in any player-selected pay lines 12, such as "three of a kind", "four of a kind" and "five of a kind" for the animal game symbols 8*a* and other combinations of a "full house", "straight" or "flush" for the playing card game symbols 8*b*. It will be appreciated that other winning combinations of game symbols 8 can also be provided. If so, the electronic game gaming machine 1 enters a winning game state and awards a prize according to the displayed predetermined winning combination(s).

The electronic game controller 4 also determines the appearance of the diamond scatter symbols 8*c* in the base game 20, typically through a random determination. However, it will be appreciated that this determination need not be totally random as the electronic game controller 4 may switch to a reel strip having a greater probability of a diamond scatter symbol 8*c* appearing where the feature game 21 has not be triggered for a predetermined number of plays of the base game 20.

Figure 3:
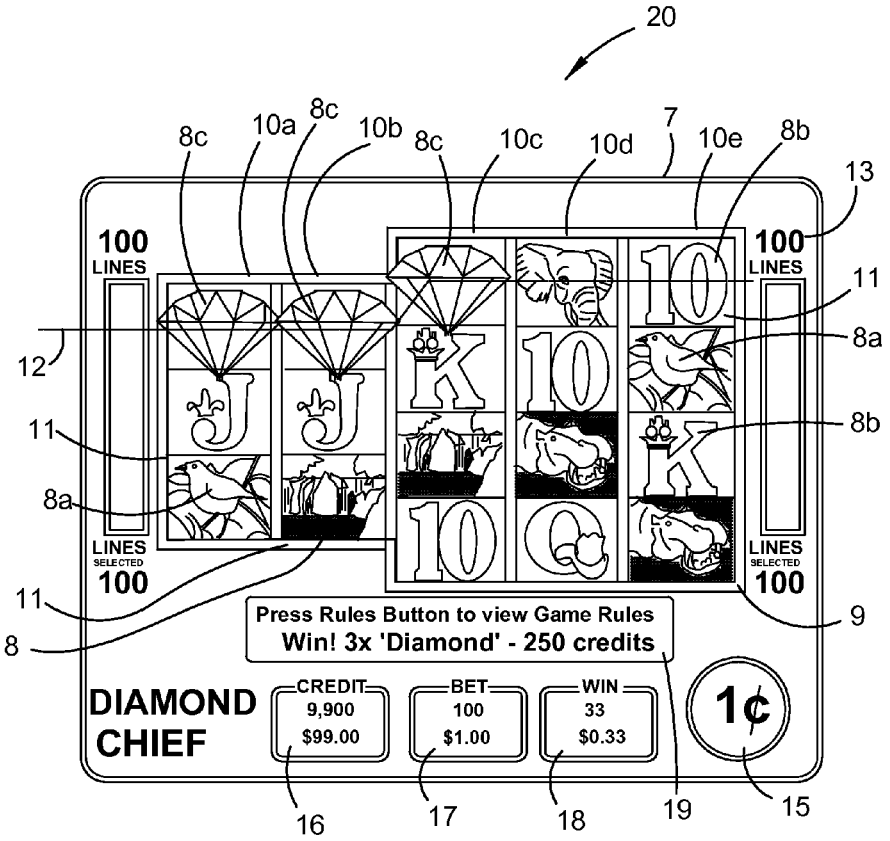
FIG. 3 is a schematic drawing illustrating a game played on the electronic gaming machine of FIG. 1, and FIGS. 4 to 7 are schematic drawings illustrating a feature game played on the electronic gaming machine of FIG. 1.
Figure 4:
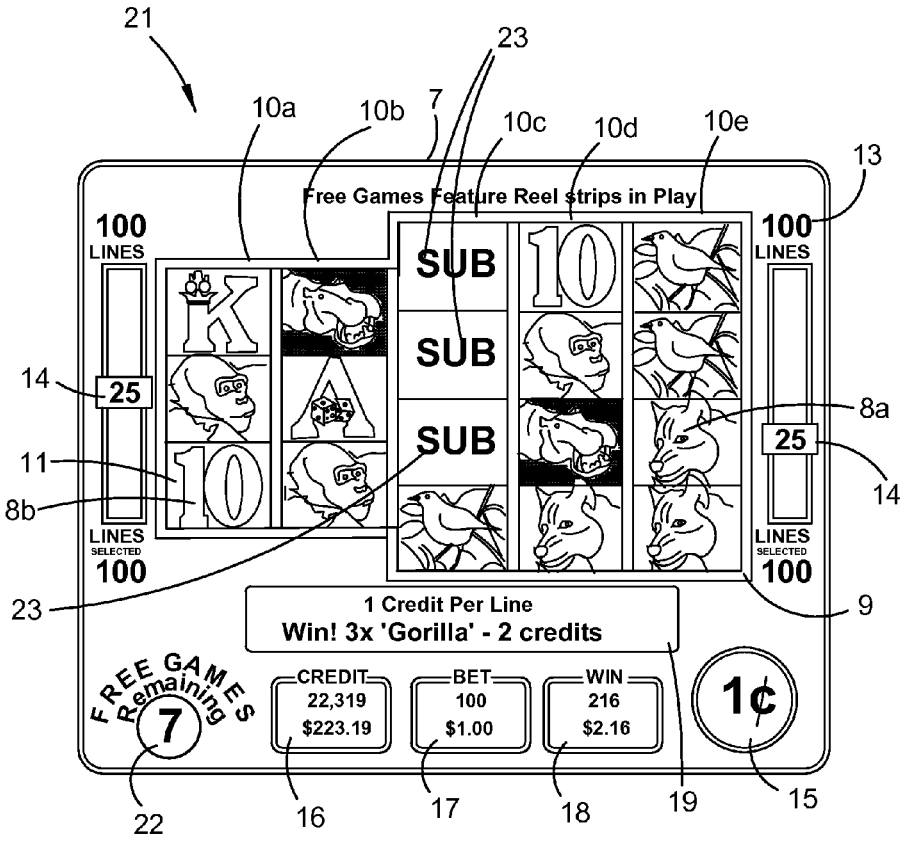

As best shown in FIG. 3, at the conclusion of a spin of the reels 12 in the base game 20, three diamond symbols 8*c* have appeared in reels 10*b*, 10*c* and 10*d*. The appearance of three scatter symbols in the form of the diamond symbols 8*c* is a trigger event in this embodiment of the invention and triggers the appearance of the feature game 21 on the array 9, as best shown in FIG. 4 where corresponding features have been given the same reference numerals.

The feature game 21 employs the same array 9 as the base game 20, as well as the same game symbols 8 that are used in the base game 20. However, if will be appreciate that the array for the feature game 21 may vary from the base game 20. For example, the feature game 21 could adopt a different format of cells and/or use an entirely different set of game symbols, or a mixture of game symbols from the base game and different game symbols.

The feature game 21 comprises a predetermined number of free plays or spins of the reels 10*a* to 10*e*. That is, the reels 10 in the feature game 21 are spun without requiring the player to make a bet, unlike the base game 20. The number of free spins remaining in the feature game 21 is indicated by image 22. In the feature game 21, predetermined winning combinations of randomly selected game symbols 8 result in the award of prizes to the player, usually of an enhanced value compared to the prizes awarded in the base game 20.

Figure 5:
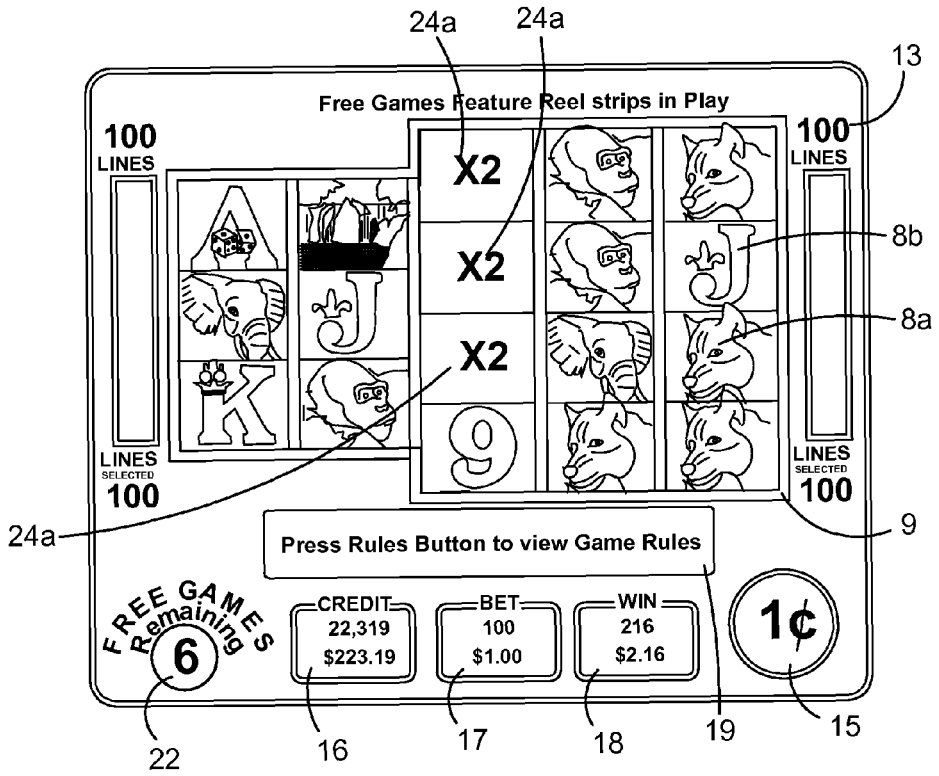
Figure 6:
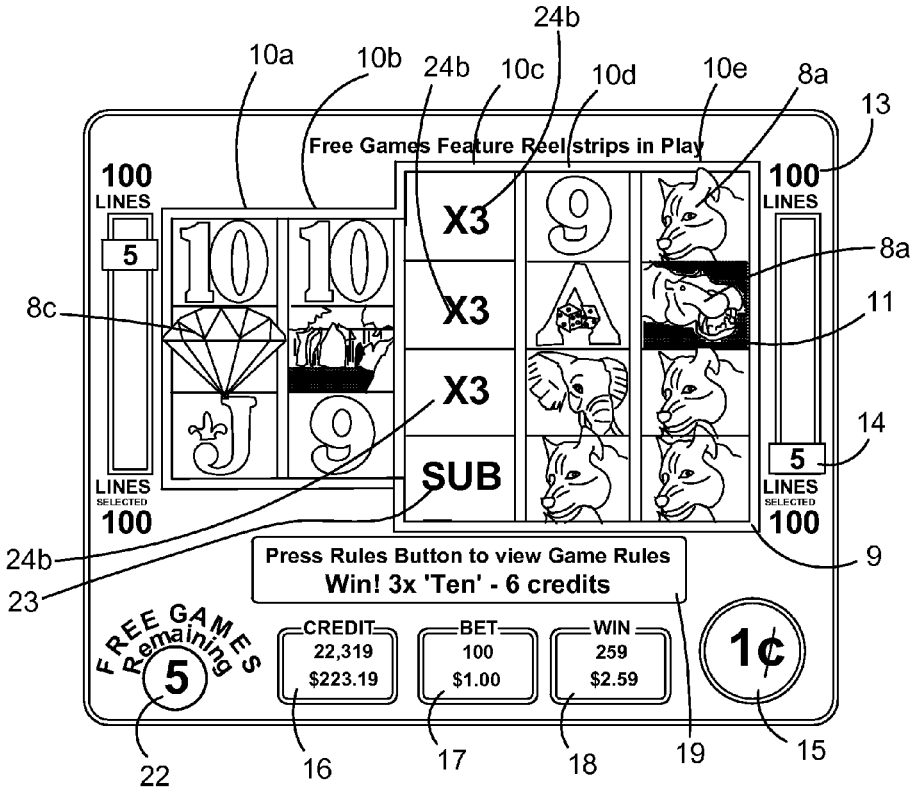
Figure 7:
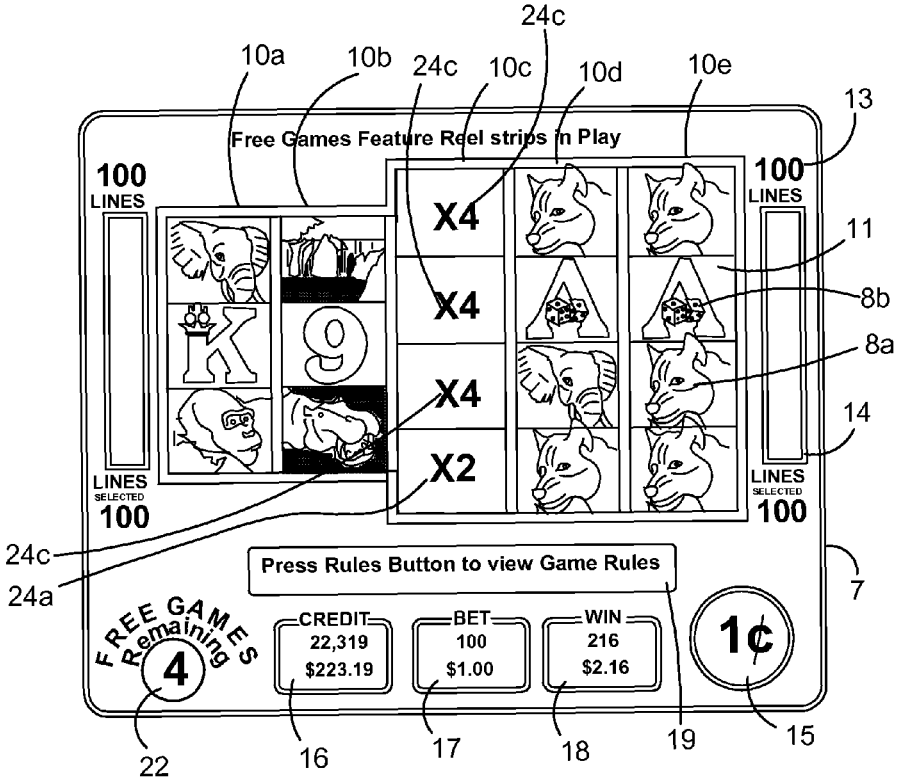

During the free spins in the feature game 21, the electronic game controller 4 randomly determines the appearance of the game symbols 8 as well as one or more indicator symbols 23, which can change into special symbols 24. In this embodiment, the indicator symbol 23 takes the form of a wild card "SUB" symbol and thus can act as any other game symbol in order to increase the probability of a predetermined winning combination appearing on this spin of the feature game. For the purposes of the game, the "SUB" indicator symbol 23 is also treated by the electronic game controller 4 as being associated with a numerical value of 1. Thus, any prize that is awarded on any predetermined winning combinations of game symbols 8 that appear on the feature game 21 using the cell 11 containing the indicator symbol 23 will be multiplied by its nominal value of 1. The special symbols 24 are also associated with a numerical value that is applied to any prize that is awarded on any predetermined winning combinations of game symbols 8 that appear on the feature game 21. In this embodiment, the special symbols 24 take the form of multiplier symbols, as best shown in FIGS. 5 to 7, where corresponding features have been given the same reference numerals.

In this embodiment, there are several different types of multiplier symbols 24, each of which are associated with different numerical values. For example, multiplier symbol 24*a* takes the form of a "×2" multiplier symbol and is associated with the number 2. The "×2" multiplier symbol indicates its association with the number 2 by showing is associated number as part of the symbol. Multiplier symbol 24*b* takes the form of an "×3" multiplier symbol and is associated with the number 3. The "×3" multiplier symbol 24*b* also indicates its association with the number 3 by showing is associated number as part of the symbol. Likewise, the multiplier symbol 24*c* takes the form of an "×4" multiplier symbol and is associated with the number 4. It will be appreciated that other numerical values can be used for the multiplier symbols 24.

The multiplier symbols 24 are applied to increase the value of any prizes awarded for predetermined winning combinations appearing on the reels 10*a* to 10*e* during any of the free spins. In this embodiment, the increase is achieved by multiplying the value of the prize by the number associated with the multiplier symbols 24. For example, where an "×2" multiplier symbol 24*a* appears on a reel 10 in the array 9, any prizes that are awarded for predetermined winning combinations on the player-selected pay lines 12 that include the cell 11 that has the "×2" multiplier symbol 24*a* are immediately multiplied by 2 to increase their value. In addition, for each subsequent spin, the multiplier symbol 24 is held in its cell 11 and has its associated numerical value sequentially increased. This may be shown by partly changing the multiplier symbol 24 to indicate its increased numerical value, or replacing the multiplier symbol with a new multiplier symbol showing its increased numerical value.

The conclusion of free spin in the feature game 21 is shown in FIG. 4, where three "SUB" indicator symbols 23 appear in the top three cells of the middle reel 10*c*. This indicates to the player that for the remaining free spins, the "SUB" symbols 23 will be replaced with multiplier symbols 24 having sequentially increasing values. This enhances the player's excitement and anticipation for the results of the remaining free spins, since the player will know that there is an increased probability of obtaining prizes of greater value for the remainder of the feature game 21 if a predetermined winning combination occurs in those subsequent free spins that includes one of the cells 11 currently occupied by the "SUB" indicator symbol 23.

In the next free spin of the feature game 21, the "SUB" indicator symbols 23 that were displayed in the preceding free spin are held in their respective cells 11 of the middle reel 10*c*. The other reels 10*a*, 10*b*, 10*d*, 10*e* are spun, as well as the remaining cells 11 in middle reel 10*c*. At the conclusion of this free spin, the "SUB" indicator symbols 23 are replaced by "×2" multiplier symbols 24*a*, as best shown in FIG. 5. Thus, the cells 11 in the middle reel 10*c* that originally had a "SUB" indicator symbol 23 now display an "×2" multiplier symbol 24*a*. Accordingly, any prizes that are awarded for predetermined winning combinations on the player-selected pay lines 12 that include any of the cells 11 that have the "×2" multiplier symbols 24*a* are immediately multiplied by 2 to increase their value.

In subsequent free spin of the feature game 21, the reels 10*a* to 10*e* are spun again while the "×2" multiplier symbols 24*a* that were displayed in the preceding free spin are held in their respective cells 11 of the middle reel 10*c*. At the conclusion of this free spin, the "×2" multiplier symbols 24*a* have their numerical values increased by one, as best shown in FIG. 6. Thus, the cells 11 in the middle reel 10*c* that originally had an "×2" multiplier symbol 24*a* now display an "×3" multiplier symbol 24*b*. In addition, another "SUB" indicator symbol 23 has appeared in the bottommost cell 11 in the middle reel 10*c*.

Accordingly, any prizes that are awarded for predetermined winning combinations on the player-selected pay lines 12 that include any of the cells 11 that have the "×3" multiplier symbols 24*b* are immediately multiplied by 3 to increase their value. The player will also know that all future free spins have an added chance of increasing the value of any prizes won on predetermined winning combinations since the "SUB" indicator symbol 23 will change to a multiplier symbol 24 whose numerical value will sequentially increase with each successive free spin.

In the next spin the "×3" multiplier symbols 24*b* and the "SUB" indicator symbol 23 displayed in the cells 11 of middle reel 10*c* are held while the remaining reels 10*a*, 10*b*, 10*d*, 10*e* are spun. At the conclusion of this spin, no new "SUB" indicator symbols 23 have appeared. As such, the multiplier symbols 24*b* displayed in the cells 11 of middle reel 10*c* increase their numerical value by one, with the three "×3" multiplier symbols 24*b* now becoming "×4" multiplier symbols 24*c* and the "SUB" indicator symbol 23 now becoming a "×2" multiplier symbol 24*a*, as best shown in FIG. 7. Accordingly, any prizes that are awarded for predetermined winning combinations on the player-selected pay lines 12 that include any of the cells 11 that have the "×4" multiplier symbols 24*c* are immediately multiplied by 4 to increase their value. Similarly, any prizes that are awarded for predetermined winning combinations on the player-selected pay lines 12 that include the bottommost cell 11 that has the "×2" multiplier symbol 24*a* are immediately multiplied by 2 to increase their value.

This sequential increase of the numerical values for the multiplier symbols 24 continues for each subsequent free spin up to a maximum numerical value of eight. That is, once the multiplier symbols 24 sequentially increase in numerical value to an "×8" multiplier symbol it no longer increases in numerical value for any remaining free spins. Instead, for each remaining subsequent free spin the "×8" multiplier symbol 24 retains its numerical value until the feature game 21 is completed. Where the numerical value limit of 8 is not reached, the sequential increasing of the numerical values for the multiplier symbols 24 continues for each subsequent free spin until the feature game 21 is completed. Upon completion of the feature game 21, the electronic game controller 4 returns the electronic gaming machine 1 to displaying the base game 20 on the video display screen 7.

This numerically increasing multiplier effect thus increases the probability that the player will obtain prizes of higher value than just simply playing a base game or even standard feature game on the electronic gaming machine. As a consequence, player excitement and interest in the electronic gaming machine 1 is enhanced, encouraging the player to keep playing the electronic gaming machine.

In other preferred forms, the multiplier symbols 24 keep sequentially increasing in their numerical values without limit until the feature game 21 is completed. Also, in another preferred form, further free spins are triggered during game play of the feature game 21, allowing the multiplier symbols 24 to keep sequentially increasing to their maximum limit of 8 or with no limit at all.

In one preferred form, no indicator symbols 23 are required and instead the multiplier symbols 24 simply randomly appear on the reels 10 and increase the prize value of predetermined winning combinations accordingly.

In a further preferred form, the indicator symbols 23 and multiplier symbols 24 can be confined to appearing in one or more designated reels and not just randomly appearing in any of the reels 10*a* to 10*e* as in the present embodiment.

Also, where the multiplier symbols 24 appear in more than one reel, then the numerical values of the multiplier symbols are combined for any prizes awarded on predetermined winning combinations that use the cells having more than one multiplier symbol 24. For example, an "×2" multiplier symbol 24*a* is shown in reel 10*a* and an "×3" multiplier symbol 24*b* is shown in reel 10*d*. Where a predetermined winning combination uses the "×2" multiplier symbol 24*a* and "×3" multiplier symbol 24*b*, then the prize awarded by multiplied by the combined value of 5, being the sum of the numerical values of the "×2" multiplier symbol 24*a* and "×3" multiplier symbol 24*b*. Alternatively, the combined numerical value can be 6, being the product of the numerical values of the "×2" multiplier symbol 24*a* and "×3" multiplier symbol 24*b*.

While the preferred embodiment has been described as sequentially increasing the numerical values of the multiplier symbols 24 by one after each spin, it will be appreciated that the numerical values can be increased by any number, such as for example sequentially increasing the numerical values by two, three or five after each free spin.

Similarly, in the preferred embodiment, the indicator symbols 23 and multiplier symbols 24 change at the conclusion of the next spin. However, the invention is not limited in this manner and in other preferred forms, the indicator symbols 23 and multiplier symbols 24 change before or during the next spin.

In other preferred forms, the invention is implemented using game symbols associated with numerical values other than multiplier symbols. Thus, these game symbols have a similar effect to the multiplier symbols 24 in the preferred embodiment. These game symbols having associated numerical values that are applied to prizes awarded in the player-selected feature games include an all wins multiplier, a symbol multiplier, a wheel with numerous multipliers or free game values as outcomes, a jackpot level value, a bonus prize value or any other such numerical application. For example, a bonus credit symbol associated with one or more credit values, such as 50, 100, 150 and 200 credits, may be used instead so that any prize that is awarded on predetermined winning combinations that use the cells having the bonus credit symbol is increased by the amount of 50 for the initial free spin, and is sequentially increased by 50 credits for each subsequent free spin by 100, 150 and 200 credits respectively.

In one preferred form, the invention is implemented in only the base game 20 rather than in the feature game 21. In this preferred form, the base game would generally operate as described above in relation to FIGS. 3 to 7, but the sequentially increasing numerical values conferred by the special symbols would take effect in subsequent paid plays of the base game. Likewise, the invention can be implemented as a feature game only, so that the trigger event only occurs in the feature game 21 instead of the base game 20 as in the present embodiment. It will be appreciated that the subsequent plays need not be successive plays, but could be later in a sequence of plays of the base game and/or feature game.

In another preferred form, the plays or spins need not be free as described in the preferred embodiment. Rather, the player may be required to make a further bet in order to play the spins in which the multiplier symbols 24 appear and sequentially increase.

It will be appreciated that the invention also includes other types of associations between the prize value increase and the numerical values. For example, the prize value could be increased by simply adding the numerical value to the prize value. Another type of association involves increasing the prize value by replacing or supplementing one of the digits of the prize value. For example, a numerical value of 3 is associated with a special symbol and a prize value of, say, 250 credits could be increased by adding the number 3 into the prize value number to create increased prize values of 2503, 2530, 2350 and 3250 credits. Using the same example, the number 3 could replace the first digit to create an increased prize value of 350 credits.

Also, the arrangement of the base game 20 and the feature game 21 is not limited to a set of reels or columns, but could take other forms, such as non-rectangular arrays (i.e. arrays that do not comprise rows and columns). For example, where the array is circular, the predetermined game positions can take the form of pie-shaped slices or wedges.

While the same game format is essentially used across the base game 20 and feature game 21, it will be appreciated that the game format may vary across both base games and feature games. For example, the base game 20 may be a wheel-type game or a four reel game and the feature game 21 may be a standard five reel game. Similarly, the base game 9 and feature game 21 may each have different game symbols, game rules and pay tables that are unique to each game.

Also, in another preferred form, there is no need for a trigger event in the form of the appearance of a predetermined number of trigger symbols. Instead, the electronic game controller 4 can internally determine when to trigger the feature game 21 in the base game 20. One way to implement this preferred form is for the electronic game controller 4 to internally generate a random number and checks if it is a predetermined number or within a predetermined range of numbers that will initiate the appearance of the indicator symbol 23 and/or special symbols 24. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur in the base game 20 and activating the feature game 21.

While the embodiment of the invention has been described in relation to a base game and a feature game, it will be appreciated that the invention could include one or more additional feature games that are triggered by specific trigger symbols appearing in the feature game 21. Also, the additional feature games may also have trigger symbols that trigger further feature games in a cascading fashion. These additional and further feature games could have the same game play elements as the feature game 21 or be different feature games entirely.

Also, in a further preferred form, the player can selectively stop spinning of the reels 10 in the base game 20 and feature game 21 to increase player interaction. Furthermore, the player can start spinning of the reels 10 in the base game 20 and feature game 21 to further enhance player interaction.

In other preferred forms, the base game 20 and feature game 21 are displayed on a single display screen adjacent each other, rather than the feature game 21 replacing the base game 20. Alternatively, the base game 20 and feature game 21 are displayed on two separate display screens.

In another preferred form, the video display screen is a touch screen for use in addition to the player-actuatable buttons 6 so as to enable the player to select various features, such as making monetary bets for the game and responding to any messages or requests issued on the electronic gaming machine 1 by the electronic game controller 4. In this case, the player may control when the reels 10 start spinning and stop spinning in any of the base game 20 and feature game 21 by simply touching the relevant reel 10.

In yet a further preferred form, the base game 20 uses the indicator symbol 23 or multiplier symbols 24 as trigger symbols, effectively replacing the scatter diamond symbols 8*c*. In this case, any indicator symbol 23 or multiplier symbols 24 that appear on the reels 10 trigger the feature game 21, and sequentially increases at the first free spin of the feature game 21. Alternatively, the indicator symbol 23 or multiplier symbols 24 that appear on the reels 10 trigger the feature game 21 but does not cause the multiplier effect or its sequential increase to apply until a further indictor symbol 23 or multiplier symbol 24 appears in one of the free spins on the reels 10.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during gameplay. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In another aspect, the invention includes a computer program configured to perform the invention. In this way the invention can be implemented in various ways on an electronic gaming machine. In a further aspect, the invention includes a computer system configured comprising a central processing unit configured for communication with an electronic gaming machine to perform the invention. In a yet another aspect, the invention includes a non-transitive carrier medium carrying computer executable code that, when executed on a central processing unit configured for communication with an electronic gaming machine, causes said central processing unit to perform the invention. In this case, the non-transitive carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of not have a specific trigger event can be readily combined with the feature of each the numerical values associated with each multiplier symbol 24 sequentially increasing until the feature game 21 is completed.

By providing a game that uses one or more special symbols with associated numerical values that provide increases in the value of prizes based on winning combinations using those special symbols appearing in a play of the feature game and that sequentially increase after each subsequent play, the invention increases player excitement and thus interest in the game, thus encouraging the player to continue playing the same electronic gaming machine. Furthermore, the appearance of the special symbols enhances the player's anticipation during plays or spins of the game, as the player knows that the appearance of a special symbol means that any prizes awarded on winning combinations are significantly increased and that future winning combinations will award prizes of greater value as the numerical value increasing the prize value sequentially increases with every play or spin. All these advantages of the invention result in the player being more likely to retain interest in continuing to play the same electronic gaming machine. Furthermore, since the electronic game controller controls operation of the base game and feature game, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a cabinet having a console, a display and an internal electronic game controller, said console having an input device in electronic communication with said electronic game controller, said input device for receiving inputs from a player to play a game on said electronic gaming machine, and having vending slots for receiving monetary bets, said display in electronic communication with said electronic game controller for displaying game symbols for playing said game, where game symbols are arranged in an array of predetermined game positions and predetermined winning combinations of randomly selected game symbols displayed on said array in said game award prizes to a player, and said electronic game controller being adapted to determine if a bet has been made using the vending slots to initiate play of said game and to control the display of game symbols on the display if a bet has been received, wherein said electronic game controller determining the appearance of one or more special symbols in said game, said special symbols being associated with numerical values, the appearance of at least one special symbol in a first predetermined game position of a predetermined winning combination displayed on said array in a first play of said game causes said electronic game controller to increase the value of a prize awarded for said predetermined winning combination, said increase being associated with the numerical value associated with said at least one special symbol, said electronic game controller sequentially increases the numerical value associated with said at least one special symbol for one or more subsequent plays of said game; and in each said subsequent play, said electronic game controller increases the value of a prize awarded for any predetermined winning combinations comprising said at least one special symbol displayed in said first predetermined game position, said increase being associated with the sequentially increased numerical value.

2. The electronic gaming machine of claim 1, wherein said at least one special symbol is displayed in said first predetermined game position in each subsequent play of said game.

3. The electronic gaming machine of claim 1, wherein said numerical value sequentially increases by one for each said subsequent play of said game.

4. The electronic gaming machine of claim 1, wherein said increase comprises multiplying the prize by said numerical value.

5. The electronic gaming machine of claim 1, wherein said increase of said prize for said subsequent plays comprises multiplying the prize by said sequentially increased numerical value.

6. The electronic gaming machine of claim 1, wherein said sequential increase of said numerical value occurs for a predetermined number of subsequent plays of said game.

7. The electronic gaming machine of claim 1, wherein said at least one special symbol appears in a predetermined portion of said array to trigger said sequential increase in said numerical value for said subsequent plays of said game.

8. The electronic gaming machine of claim 7, wherein said array comprises rows and columns and said predetermined portion comprises a designated column, wherein said designated column comprises a plurality of predetermined game positions.

9. The electronic gaming machine of claim 1, wherein said special symbols comprise one or more multiplier symbols.

10. The electronic gaming machine of claim 1, wherein where more than one special symbol appears in said first play or said subsequent plays, the numerical value associated with each said special symbol is applied simultaneously to each prize awarded on predetermined winning combinations appearing in said first play or said subsequent plays.

11. The electronic gaming machine of claim 1, wherein said game comprises an indicator symbol for indicating the appearance of said special symbols.

12. The electronic gaming machine of claim 11, wherein said indicator symbol appears in said first predetermined game position.

13. The electronic gaming machine of claim 11, wherein said indicator symbol appears in said first predetermined game position in a preceding play of said game preceding said first play.

14. The electronic gaming machine of claim 1, wherein said numerical value associated with said at least one special symbol is indicated on said display.

15. The electronic gaming machine of claim 1, wherein said sequential increase in said numerical value is indicated during said subsequent plays of said game.

16. The electronic gaming machine of claim 1, wherein said special symbol also acts as at least one of a replacement symbol, a wild card symbol, a scatter symbol, bonus prizes, collector symbols, a win multiplier, wild multipliers, bonus wilds, random wild symbols, progressive symbols, bonus credits and jackpot symbols.

17. The electronic gaming machine of claim 1, wherein said subsequent plays are successive plays of said game.

18. The electronic gaming machine of claim 1, wherein said subsequent plays occur within a predetermined number of plays of said game.

19. The electronic gaming machine of claim 1, wherein said sequential increase of said numerical value occurs for a predetermined number of subsequent plays of said game.

20. The electronic gaming machine of claim 1, wherein said first play and said subsequent plays are consecutive.

* * * * *